US012508484B2

(12) United States Patent
Underwood

(10) Patent No.: US 12,508,484 B2
(45) Date of Patent: Dec. 30, 2025

(54) BEACH GAME AND RACK ASSEMBLIES

(71) Applicant: BOMBWATCHER INC., Cocoa Beach, FL (US)

(72) Inventor: Clinton Underwood, Indialantic, FL (US)

(73) Assignee: BOMBWATCHER INC., Cocoa Beach, FL (US)

( * ) Notice: Subject to any disclaimer, the term of this patent is extended or adjusted under 35 U.S.C. 154(b) by 0 days.

(21) Appl. No.: 15/934,696

(22) Filed: Mar. 23, 2018

(65) Prior Publication Data

US 2018/0272212 A1 Sep. 27, 2018

Related U.S. Application Data

(60) Provisional application No. 62/476,348, filed on Mar. 24, 2017.

(51) Int. Cl.

| | |
|---|---|
| ***A63B 67/06*** | (2006.01) |
| ***A63B 71/00*** | (2006.01) |
| ***A63B 71/02*** | (2006.01) |
| ***A63B 71/06*** | (2006.01) |
| ***A63F 9/02*** | (2006.01) |
| ***A63H 33/18*** | (2006.01) |
| ***B63B 32/83*** | (2020.01) |

(52) U.S. Cl.

CPC ..... *A63B 67/06* (2013.01); *A63B 71/023* (2013.01); *B63B 32/83* (2020.02); *A63B 2067/063* (2013.01); *A63B 71/0036* (2013.01); *A63B 2071/024* (2013.01); *A63B 71/0672* (2013.01); *A63B 2210/50* (2013.01); *A63B 2225/682* (2013.01); *A63F 2009/0213* (2013.01); *A63H 33/18* (2013.01)

(58) Field of Classification Search

CPC ..... A63B 67/06; A63B 2067/063; B63B 35/7946

USPC ..... 273/348, 336, 332, 338, 339, 343, 406, 273/407; 473/286

See application file for complete search history.

(56) References Cited

U.S. PATENT DOCUMENTS

| | | | | | |
|---|---|---|---|---|---|
| 1,230,503 | A * | 6/1917 | Miller | A63B 67/06 | 273/336 |
| 3,119,619 | A * | 1/1964 | Frank | A63F 9/0208 | 248/156 |
| 3,507,496 | A * | 4/1970 | Miller | A63B 67/06 | 273/339 |
| 3,810,625 | A * | 5/1974 | Gulling | A63F 9/0243 | 273/338 |
| 3,989,250 | A | 11/1976 | Lakeman | | |
| D264,483 | S * | 5/1982 | Raymond | D21/304 | |
| 4,726,591 | A * | 2/1988 | Johnson | A63B 67/06 | 273/338 |
| 4,966,373 | A * | 10/1990 | Houle | A63B 67/06 | 273/338 |

(Continued)

*Primary Examiner* — Joseph B Baldori

(74) *Attorney, Agent, or Firm* — McBee Moore & Vanik IP, LLC

(57) ABSTRACT

The present invention is a game assembly that includes at least one rack with two risers and either a double stake configuration or a base, at least one throwing device, and a carrying case. In one embodiment, the assembly includes at least two racks. In another embodiment, the game assembly includes a plurality of throwing devices. The racks may also be used as a support system for planar and/or elongated devices.

11 Claims, 7 Drawing Sheets

(56) References Cited

U.S. PATENT DOCUMENTS 5,067,727 A * 11/1991 Crompton ..... A63B 67/06 473/573
5,290,041 A * 3/1994 Kettelson ..... A63B 67/06 273/400
5,873,573 A 2/1999 Beatty, Jr.
5,954,337 A * 9/1999 Cunningham ..... A63B 67/06 273/338
6,135,455 A * 10/2000 McNally ..... A63B 67/06 273/338
6,173,957 B1 1/2001 James, Sr.
6,241,251 B1 * 6/2001 Trifonov ..... A63B 67/06 273/339
6,889,982 B1 * 5/2005 Gove ..... A63B 63/00 273/400
8,002,126 B1 * 8/2011 Drum ..... A01K 97/08 211/195
8,011,664 B2 9/2011 Hilbert, Jr. et al.
2005/0006846 A1 * 1/2005 Roy ..... A63B 67/06 273/336
2006/0097454 A1 * 5/2006 Mattson ..... A63B 67/06 273/336
2010/0176554 A1 * 7/2010 Godwin ..... A63B 67/06 273/338
2011/0074109 A1 * 3/2011 Werth ..... A63B 59/30 273/336
2011/0215528 A1 * 9/2011 Conville ..... A63B 67/06 273/402
2011/0278796 A1 * 11/2011 Baculy ..... A63B 67/06 273/336
2013/0130759 A1 * 5/2013 Boi ..... A63B 67/002 463/2
2014/0049007 A1 * 2/2014 McGetrick ..... A63F 9/0208 273/332
2016/0023074 A1 * 1/2016 Girman ..... A63B 67/06 273/336
2016/0346802 A1 * 12/2016 McCaslin ..... A01G 25/02
2017/0021254 A1 * 1/2017 Wolf ..... A63B 67/06
2018/0014649 A1 * 1/2018 Peterson ..... A47C 4/03
2019/0070474 A1 * 3/2019 Sarvela ..... A63B 67/06
2021/0197047 A1 * 7/2021 Clark ..... A63B 67/06

* cited by examiner

BEACH GAME AND RACK ASSEMBLIES

CROSS REFERENCE TO RELATED APPLICATIONS

This application claims the benefit priority under 35 U.S.C. § 119 (e) from U.S. Provisional Application No. 62/476,348 filed Mar. 24, 2017 which application is incorporated herein by reference in its entirety.

FIELD OF THE INVENTION

The present invention relates to the field of outdoor games, specifically throwing games, and more specifically to portable game assemblies.

Additionally, the invention relates to the field of support systems, specifically to support systems for use in the outdoors, and more specifically for support of planar structures such as surf boards.

The invention also relates to the field of outdoor games which can be adapted for indoor use, specifically indoor/outdoor throwing games, and more specifically to portable game assemblies containing interchangeable parts for indoor/outdoor use.

BACKGROUND OF THE INVENTION

Informal outdoor games are popular with families and other groups in various casual settings such as, but not limited to, backyards, picnic grounds, and lake and ocean sand beaches. Although fun, often such games are cumbersome as they can include several components that must be carried from a car or beach house to the beach itself along with other non-game items such as chairs, blankets, umbrellas, etc. It is also desirable to convert such outdoor games for indoor use and vice versa.

In addition, at a beach setting, it is difficult to store items such as surf boards, umbrellas, and other planar or long, extended devices. It is especially important to store surfboards off beach sand to protect the waxed finish and to prevent the board from being washed to into the water by rising tides.

There is therefore a need in the field for an indoor/outdoor game system that enables users to easily transport game components to an indoor or outdoor site with one or more of the components configured so as to be used as a game and to provide a rack or support arrangement for surf boards and other elongated and/or planar devices.

SUMMARY OF THE INVENTION

The present invention broadly comprises a game assembly comprising: at least one target rack, each target rack having a first riser and a second riser; at least one throwing device, the throwing device having an open center; and optionally, a container for storing the said at least one target rack and the at least one throwing device. Each of said at least one target rack possesses a double stake structure.

In a preferred embodiment, the first riser of each target rack is about 14-18 inches in length and the second riser is about 12-16 inches in length.

In an alternate embodiment, the game assembly further comprises one or more additional accessories, such as but not limited to a score indicator, drink holder and leis.

In an alternate embodiment, the game assembly further comprises at least one base to which a target rack may be attached.

One object of the invention is to provide a game assembly where the game components can be carried conveniently in one container.

A second object is to supply a game assembly that is easy to assemble and disassemble.

A third object is to provide a game assembly that can be converted for indoor or outdoor use.

An alternate invention broadly comprises a rack assembly for supporting an elongated and/or planar device comprising: at least two racks, each rack having a first and second riser. Each of the at least two racks have a double stake structure.

In a preferred embodiment of the alternate invention, the first riser of each rack is about 14-18 inches in length and the second riser is about 12-16 inches in length.

In an alternate preferred embodiment, each of said stakes in the double stake structure is at least 8 inches in length.

One object of the alternate invention is to present a portable rack or support for a planar device such as a surfboard.

A second object of the alternate invention is to present a portable rack or support for an elongated device such as an umbrella.

A third object of the alternate invention is to supply a rack or support system that will keep a supported device off the ground.

An additional third object of the alternate invention is to provide a rack or support system that is easy to arrange on a beach or other natural surface.

A further alternate invention broadly comprises a game assembly comprising: at least one target rack, each target rack having a first riser and a second riser; and at least one throwing device, the throwing device having an open center. Each of said at least one target rack possesses a base.

In a preferred embodiment, the first riser of each target rack is about 14-18 inches in length and the second riser is about 12-16 inches in length.

In one embodiment of the further alternate invention, each of said at least one target rack is permanently attached to the base.

In a preferred embodiment, the base is circular and is about 20-28 inches in diameter.

In an alternate embodiment of the further alternate invention, each of said at least one target rack is removably attached to the base.

In a preferred embodiment, the removable base comprises an opening in the center of the base to enable the base to slide onto the target rack for use.

In a preferred embodiment, the bottom of each base comprises a non-slip surface to prevent the base from sliding on a surface during play.

In an additional embodiment of the further alternate invention, the game assembly further comprises a container for storing the said at least one target rack, the at least one throwing device, and/or the at least one base.

In an alternate embodiment, the game assembly further comprises one or more additional accessories, such as, but not limited to, a score indicator.

BRIEF DESCRIPTION OF THE SEVERAL VIEWS OF THE DRAWINGS

The nature and mode of the operation of the present invention will now be more fully described in the following detailed description of the invention taken with the accompanying drawing Figures, in which.

DETAILED DESCRIPTION OF EMBODIMENTS OF THE INVENTION

At the outset, it should be appreciated that like drawing numbers on different drawing views identify identical structural elements of the invention. It also should be appreciated that figure proportions and angles are not always to scale in order to clearly portray the attributes of the present invention.

While the present invention is described with respect to what is presently considered to be the preferred embodiments, it is understood that the invention is not limited to the disclosed embodiments. The present invention is intended to cover various modifications and equivalent arrangements included within the spirit and scope of the appended claims.

Furthermore, it is understood that this invention is not limited to the particular methodology, materials and modifications described and as such may, of course, vary. It is also understood that the terminology used herein is for the purpose of describing particular aspects only, and is not intended to limit the scope of the present invention, which is limited only by the appended claims.

Unless defined otherwise, all technical and scientific terms used herein have the same meaning as commonly understood to one of ordinary skill in the art to which this invention belongs. It should be appreciated that the term "substantially" is synonymous with terms such as "nearly", "very nearly", "about", "approximately", "around", "bordering on", "close to", "essentially", "in the neighborhood of", "in the vicinity of", etc., and such terms may be used interchangeably as appearing in the specification and claims. It should be appreciated that the term "proximate" is synonymous with terms such as "nearby", "close", "adjacent", "neighboring", "immediate", "adjoining", etc., and such terms may be used interchangeably as appearing in the specification and claims. Although any methods, devices or materials similar or equivalent to those described herein can be used in the practice or testing of the invention, the preferred methods, devices, and materials are now described.

Figure 1:
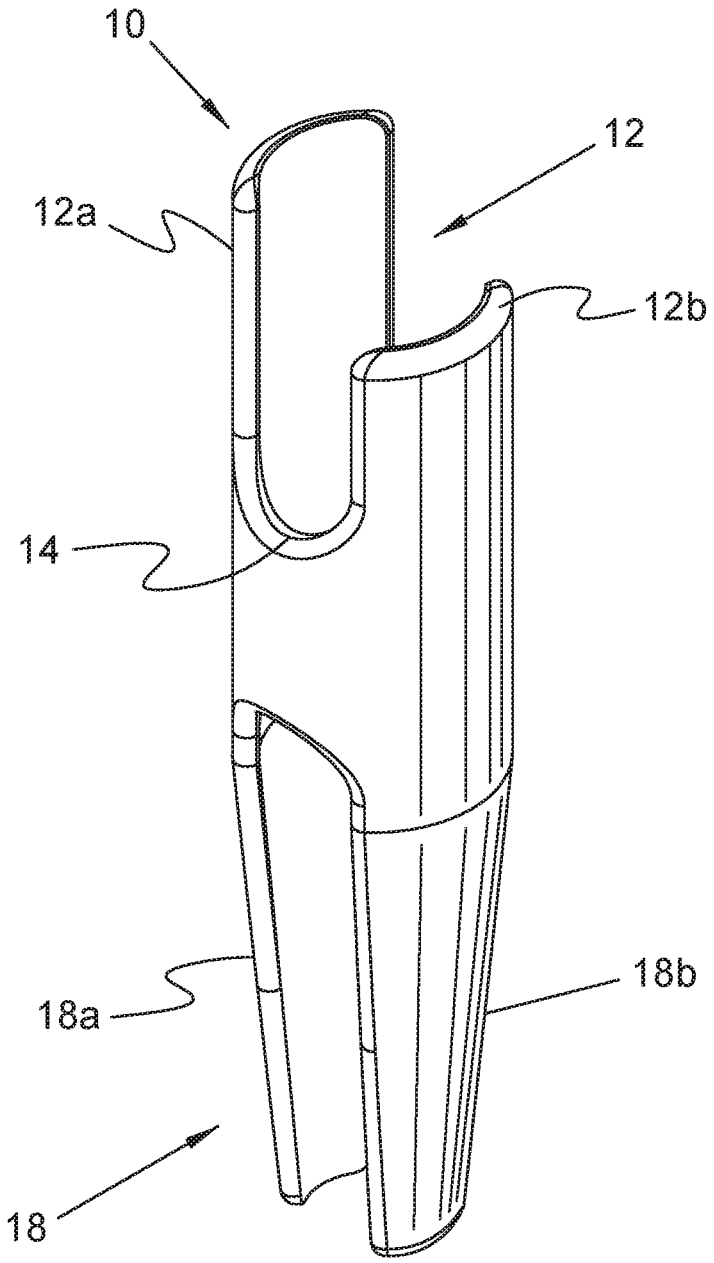
FIG. 1 is a top perspective view of a target rack of the present invention.

Adverting to the drawings, FIG. 1 is a top perspective view of target rack 10 ("rack 10") which is the target for throwing devices. Rack 10 includes first riser 12*a* and second riser 12*b*. In the preferred embodiment shown, first riser 12*a* is longer than second riser 12*b* is. In one embodiment, first riser 12*a* may range in length from 14-18 inches and second riser 12*b* ranges in length from 12-16 inches, as measured from curve 14 in rack 10. It will be recognized that first riser 12*a* and second riser 12*b* may be of any suitable respective lengths including having equal lengths. Preferably, the game assembly will have a plurality of racks 10.

In some embodiments, each target rack 10 also includes a double stake structure 18 comprising two stakes 18*a* and 18*b*. By double stake structure is meant that the bottom half of rack 10 is shaped to form two stakes integral with or attached to the stake. By integral is meant that the component parts of an item are formed together as a single unit. When preparing the game for play the two stakes 18*a* and 18*b* of double stake structure 18 are pushed into the ground or beach to hold rack 10 in an upright position. The use of two stakes 18*a* and 18*b* with each rack 10 provides the advantage of additional stability over using one stake bottom, especially in loose soil such as beach sand. FIG. 1 illustrates an embodiment in which the double stake structure 18 is integral with the rack 10. In other embodiments discussed below, the double stake structure is an insert 19 that may be removably attached to the rack 10.

Figure 2:
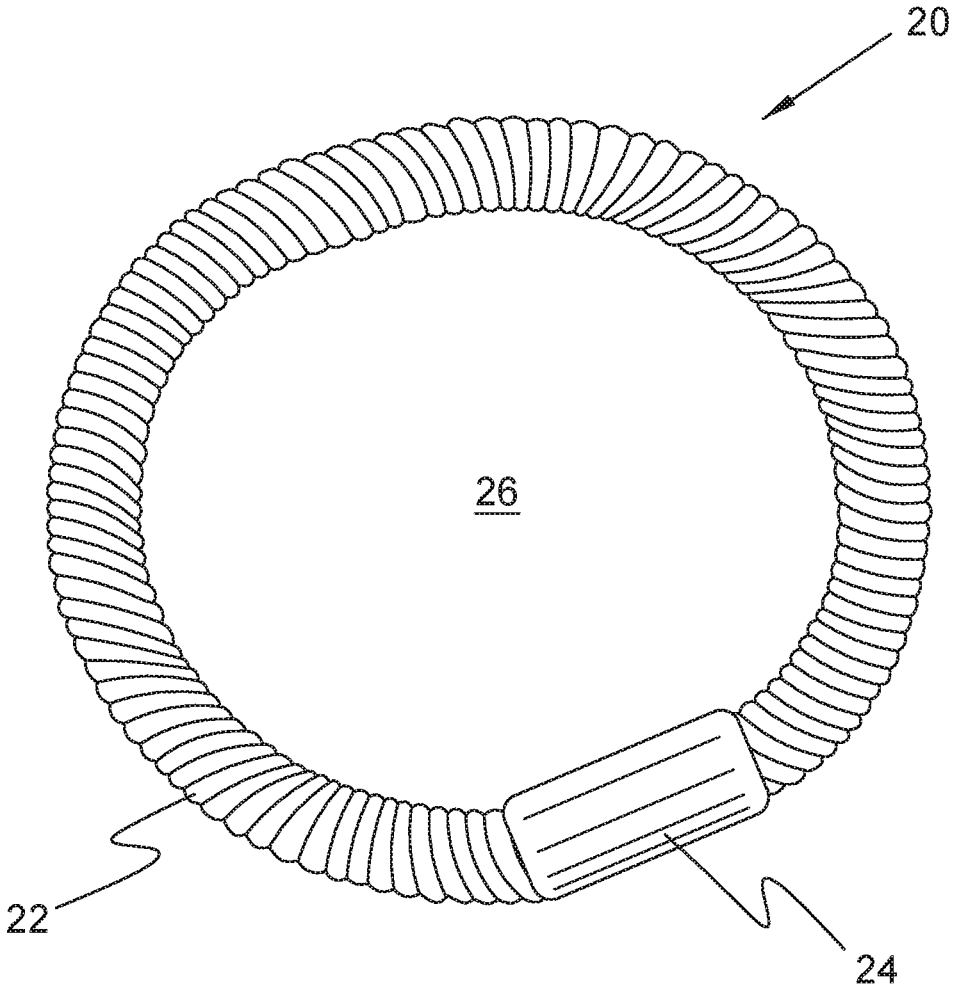
FIG. 2 is a top view of a throwing device of the present invention in which the side or sides of the throwing device surround an open center.

FIG. 2 is a top view of throwing device 20 ("device 20"). The side or sides 22 of throwing device 20 surround an open center 26. Preferably, device 20 includes a weighted portion 24 to enable throws to be made with greater accuracy. In one embodiment, device 20 is fabricated from rope. A rope is defined as a stout cord of strands of fibers or wire twisted or braided together. In other embodiments, device 20 may be fabricated from plastic, wood, metal, or other suitable materials known in the art. Although FIG. 2 depicts device 20 as generally circular in shape, it will be recognized that other shapes may be used as long as device 20 includes an open center 26.

Figure 3:
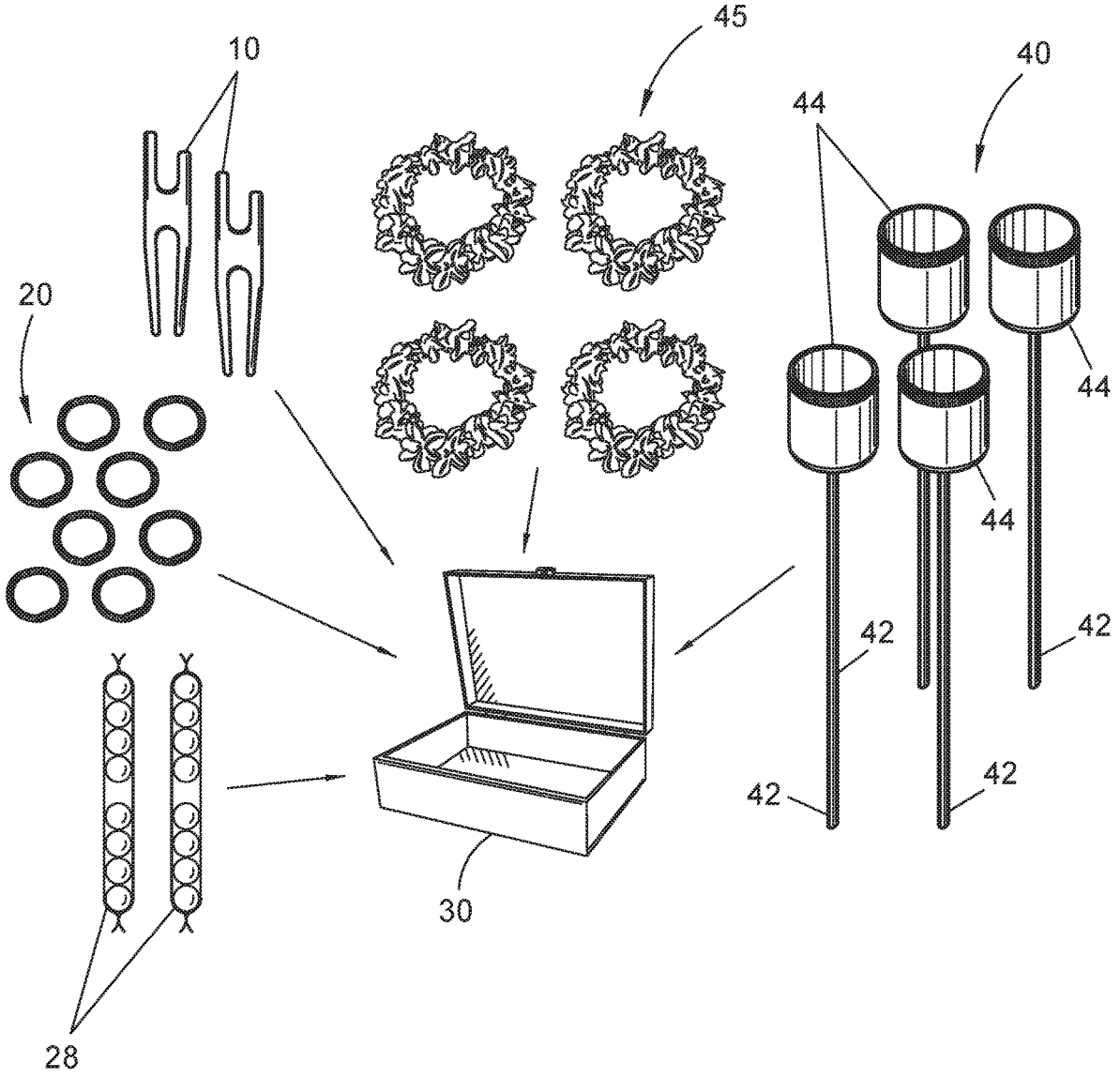
FIG. 3 depicts a carrying case and game components and accessories that may be stored and transported in the carrying case.

FIG. 3 depicts carrying case 30 ("case 30") along with game components and beach accessories that may be stored and transported in case 30. The arrows indicate that all the items shown in FIG. 3 can be stored and carried in case 30. Seen are a plurality of target racks 10 and a plurality of throwing devices 20. Also seen is score indicator 28 and drink holders 40 ("holders 40"). Drink holders 40 comprise stems 42 each having a first and second end and cup 44 sized to hold a drink container (not shown) and attached to one end of stem 42. Holders 40 may hold drinks or other items by having one end of stem 42 pushed into the ground holding the entire holder 40 upright and placing a drink container in cup 44. Decorative items, such as leis 50, or other types of items may also be stored in case 30.

Figure 4:
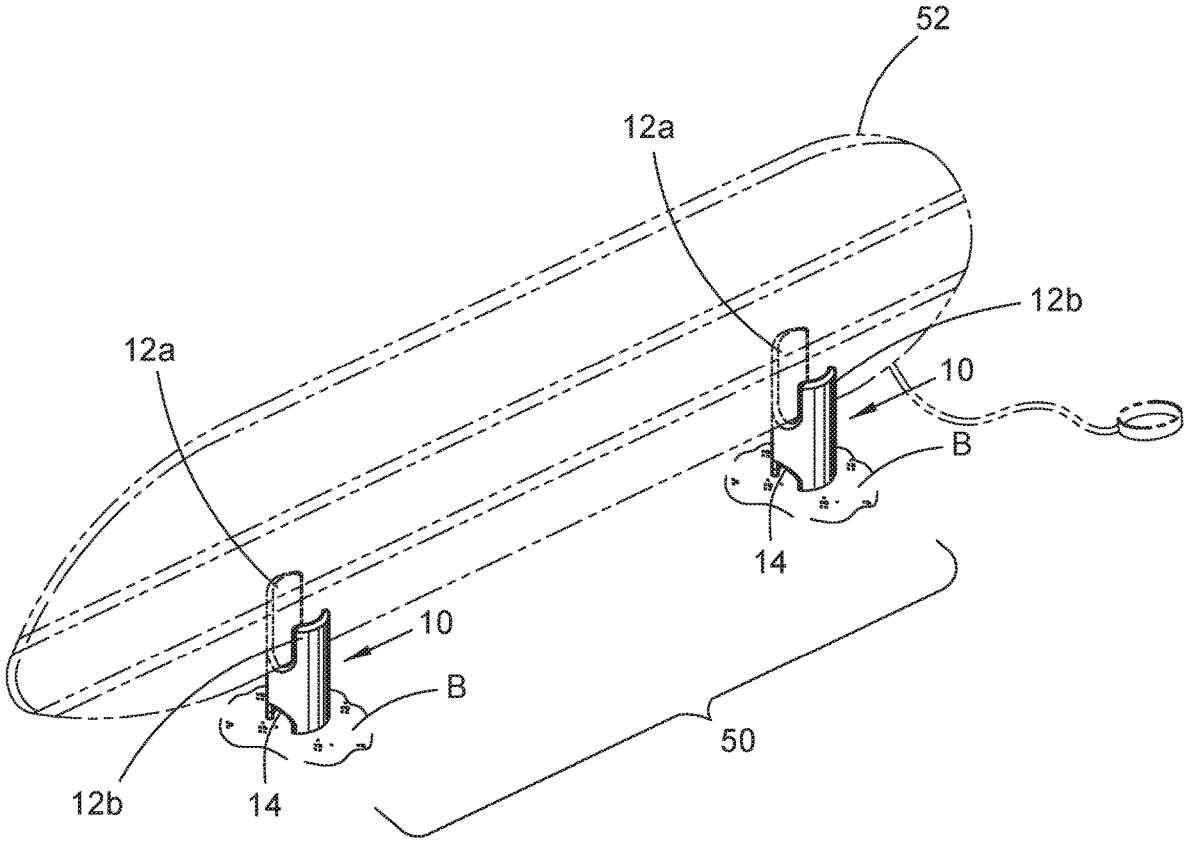
FIG. 4 is a top perspective view of a rack system for a planar and/or elongated device such as a surfboard.

FIG. 4 is a top perspective view of a rack system 50 for surfboard 52 ("board 52"). Racks 10 are seen placed into beach sand B with surfboard 52 supported between risers 12*a* and 12*b*. It can be seen that board 52 is held advantageously off the surface of beach sand B.

The material choice for the racks 10 is advantageously bamboo but can be any suitable material, such as, but not limited to, plastic, wood, or metal which allows for a sturdy and lightweight game system.

The bamboo material choice for the beach game assembly racks 10 is also designed to serve as a rack system 50 for planar and/or elongated devices. When the game is played on the beach, using the sand to hold the various stakes 18, the present invention attempts to create a versatile product to accommodate surfers who also want to play the game in that a plurality of racks 10 may be used to both play the game and support devices such as, but not limited to, surfboards and umbrellas.

By having this unique size and shape, it is possible for rack 10 to serve both as part of the game itself and to hold a surfboard or other device 52 off the sand B so that if the tide comes up, the surfboard 52 is supported off the sand and is safe from being carried away.

Figure 5:
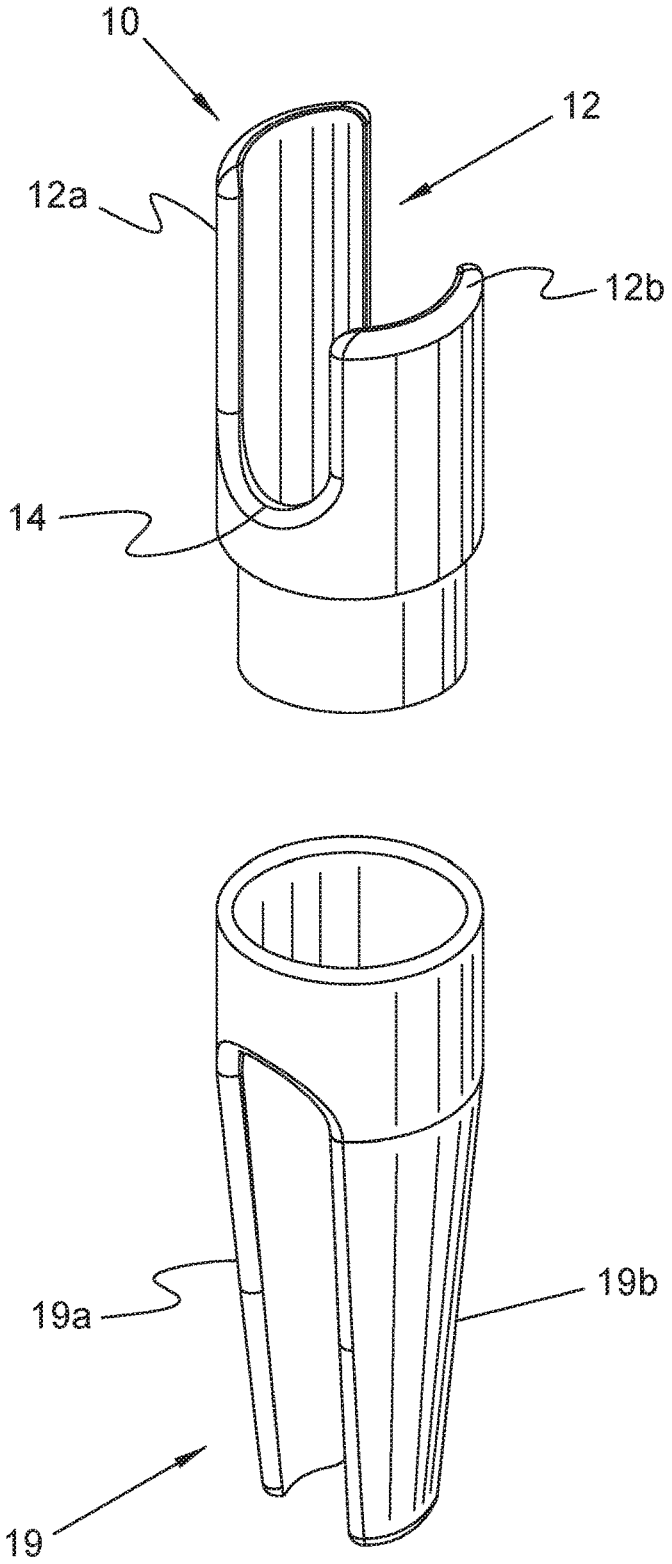
FIG. 5 is a top perspective of an embodiment of the invention in which a target rack can be removably attached to a double stake and/or a base.
Figure 6:
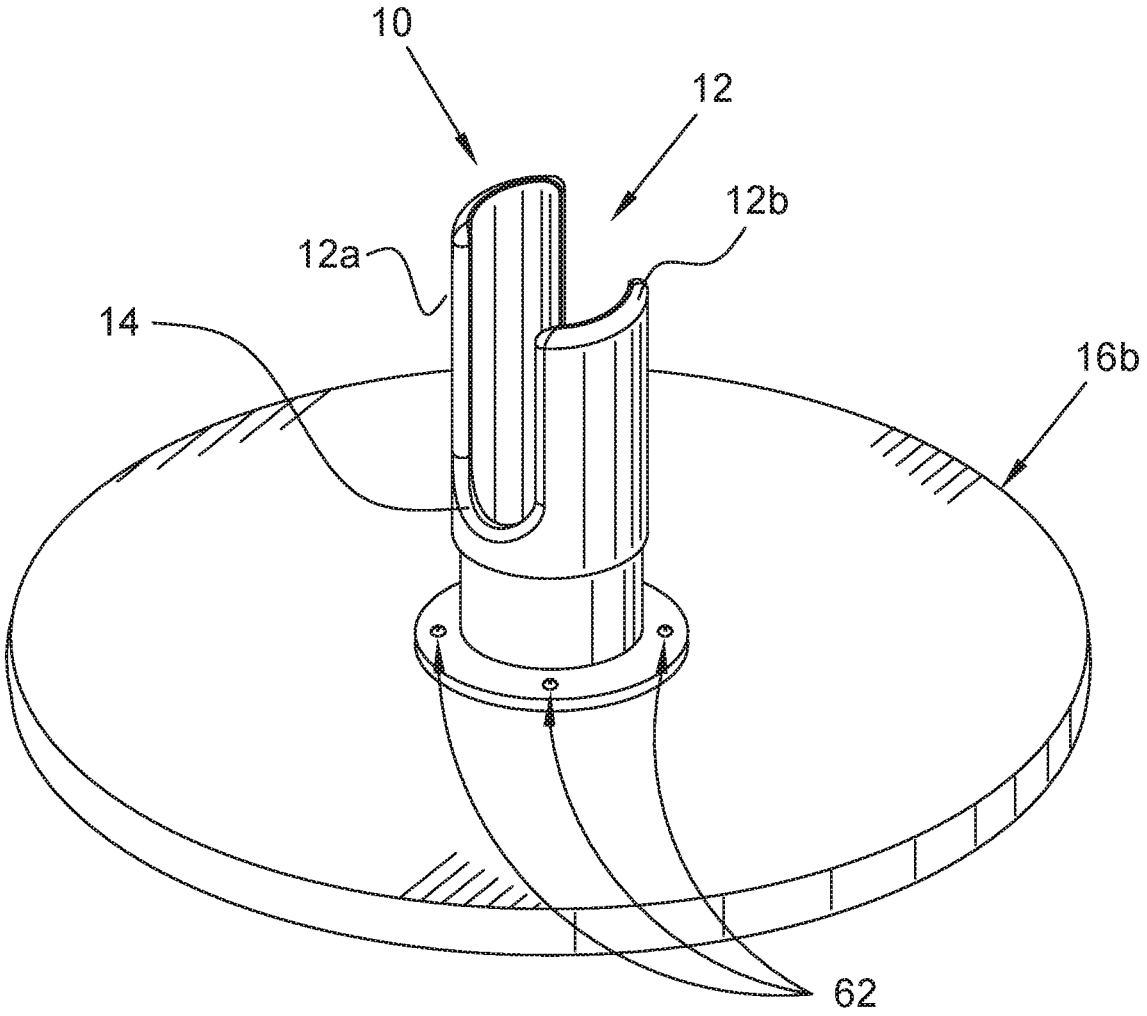
FIG. 6 is a top perspective view of a target rack of the present invention attached to a base.
Figure 7:
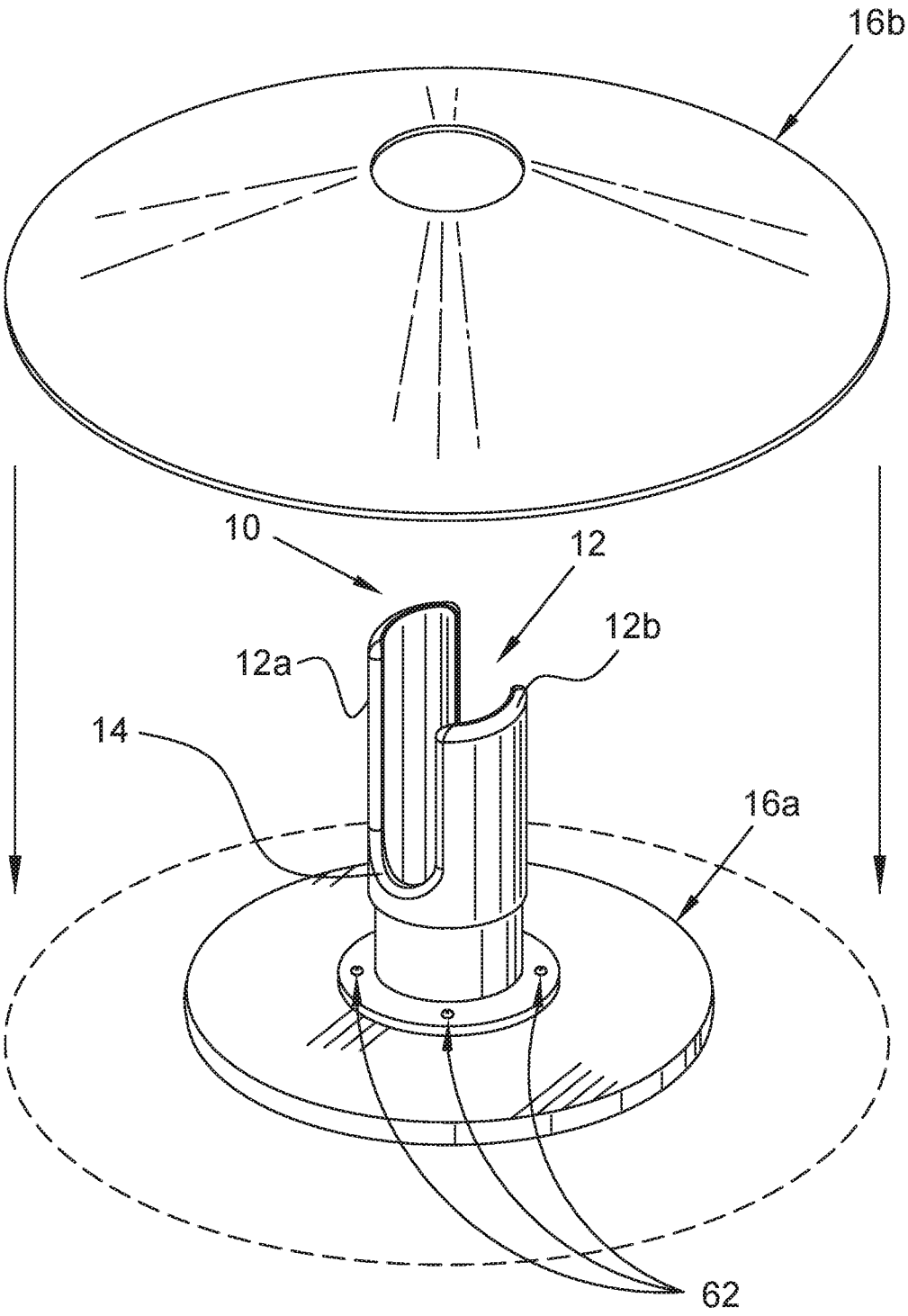
FIG. 7 is a top perspective view of a target rack and a removable base of the present invention.

FIG. 5 illustrates an alternative embodiment of the invention in which racks 10 are removably attached to an insert 19 comprising two stakes 19*a* and 19*b* which serves as a double stake structure ("double stake insert 19"). This enables the game to be converted from outdoor use to indoor use. In a preferred embodiment, the rack 10 can be removed from double stake insert 19 and attached to base 16 to allow the game to be played indoors or on any hard surface. FIG. 6 illustrates base 16 as circular. However, base 16 can be any shape that allows stability of rack 10 during play. Base 16 is preferably about 20-28 inches wide, more preferably about 22-26 inches wide, most preferably about 24 inches wide. Base 16 may be flat, as illustrated in FIG. 6, or conical, as illustrated in FIG. 7.

In this alternative embodiment, the rack 10 can be attached to base 16 by any means known in the art. Preferably, the rack 10 is designed such that it may be screwed onto either base 16 or double stake insert 19. Alternatively, rack 10 may be fit into base 16 or double stake insert 19 using a friction fit.

The material choice for base 16 and/or double stake insert 19 can be any suitable material, such as, but not limited to, plastic, bamboo, wood, rubber, or metal, which allows for a sturdy and lightweight game system.

In some embodiments, base 16 may be stored and transported in carrying case 30 with one or more of the components listed above and illustrated in FIG. 3.

FIG. 6 illustrates an additional embodiment of the invention in which a rack 10 is non-removably attached to a base 16. The rack 10 may be attached to base 16 by any suitable means known in the art. As illustrated in FIG. 6, rack 10 may be mounted onto base 16 using a plurality of screws 62 drilled into base 16 in some embodiments.

FIG. 6 illustrates base 16 as circular. However, base 16 can be any shape that allows stability of rack 10 during play. Base 16 is preferably about 20-28 inches wide, more preferably about 22-26 inches wide, most preferably about 24 inches wide. Base 16 is illustrated as flat in FIG. 6. However, it is contemplated that base 16 may be conical or any other shape that allows stability during play.

FIG. 7 illustrates an additional embodiment of the invention in which a rack 10 is removably attached to a base 16. In this embodiment, rack 10 is attached to a small base 16*a* by any means known in the art, such as, for example, using a plurality of screws 62. A large base 16*b* is designed with an opening in the center of the base such that it slides securely onto rack 10 and small base 16*a*. The large base 16*b* provides stability and also may serve as a scoring structure (i.e., points may be awarded to players when a throwing device 20 lands on the large base 16*b*).

Small base 16*a* is preferably about 6-12 inches wide, more preferably about 8-10 inches wide, most preferably about 9 inches wide. Small base 16*a* is illustrated as flat in FIG. 7. However, it is contemplated that base 16*a* may be conical or any other shape compatible with rack 10 and large base 16*b*.

Large base 16*b* is preferably about 20-28 inches wide, more preferably about 22-26 inches wide, most preferably about 24 inches wide. Large base 16*b* is illustrated as conical in FIG. 7. However, it is contemplated that base 16*b* may be flat or any other shape that allows stability during play.

The material choice for small base 16*a* and/or large base 16*b* can be any suitable material, such as, but not limited to, plastic, bamboo, wood, rubber, or metal, which allows for a sturdy and lightweight game system. Small base 16*a* and large base 16*b* may be constructed of the same material or different materials. In a preferred embodiment, large base 16*b* is rubber.

An advantage of the embodiment illustrated in FIG. 7 is increased portability of the game system due to the use of a removable base 16.

In one embodiment, to play the game, the double stake structure 18 or double stake insert 19 of each target rack 10 is inserted into the beach sand, turf, or other ground ("ground") with both first and second risers 12*a* and 12*b* of scoring end 12 extending above the surface of the ground. Preferably, one riser is longer than the other with the distance between the risers 12*a* and 12*b* no greater than the inside diameter of the weighted rope ring(s) or other device 20 associated with the game assembly. In a particular arrangement, the height of the first riser 12*a* ranges from about 14 to 18 inches and the height of second riser 12*b* ranges from about 12 to 16 inches high. Devices 20, such as rope ring 20, may be thrown by any number of players according to a scoring system established by the rope's landing near and/or encircling the rack's multiple scoring structures.

In another embodiment, to play the game, the target rack 10 and base 16 are placed on a hard surface, such as, but not limited to, a floor or concrete surface. Preferably, one riser is longer than the other with the distance between the risers 12*a* and 12*b* no greater than the inside diameter of the weighted rope ring(s) or other device 20 associated with the game assembly. In a particular arrangement, the height of the first riser 12*a* ranges from about 14 to 18 inches and the height of second riser 12*b* ranges from about 12 to 16 inches high. Devices 20, such as rope ring 20, may be thrown by any number of players according to a scoring system established by the rope's landing near and/or encircling the rack's 10 multiple scoring structures, such as, for example, the base 16.

The game can be played by any combination of one to an unlimited number of players scoring points by pitching throwing devices 20 in an attempt to land within the scoring area encircling target racks 10, about the multiple scoring risers 12*a* and 12*b* of the rack(s) 10, or on base 16.

In a preferred game application, a winner is declared when a player/players score a certain total of points associated with a desired gameplay format.

Advantages of the game assembly of the present invention are numerous over other types of games and apparatuses. The game components are light and can be carried easily from parking lot to a beach in carrying case 30. Also, the game may be set up and played anywhere within minutes due to the unique type of target racks 10 and throwing devices 20 utilized.

In addition, the game is designed to be played on a variety of surfaces, especially surfaces that enable the racks to be secured into the existing ground. Also, the game is designed to be convertible for either indoor or outdoor use.

Thus, it is seen that the objects of the invention are efficiently obtained, although changes and modifications to the invention should be readily apparent to those having ordinary skill in the art, which changes would not depart from the spirit and scope of the invention as claimed.

What is claimed is:

1. A game assembly consisting of:

at least one target rack consisting of a vertically configured first and second scoring riser;

at least one throwing device configured in a ring shape with an inside diameter greater than the distance between the first scoring riser and second scoring riser; and a container for storing the at least one target rack and the at least one throwing device;

wherein the at least one target rack has a bottom double stake structure consisting of two stakes, wherein the two stakes of the double stake structure form concave opposite walls partially surrounding a void between the stakes, wherein each stake of the double stake structure is at least 8 inches in length, wherein each stake of the double stake structure has a top end proximal to the target rack and a bottom end distal from the target rack, wherein each stake of the double stake structure is connected to each other only at the top end of each stake, wherein the target rack comprises an upward facing curve between the first scoring riser and the second scoring riser, and wherein the upward facing curve and the first and second scoring riser together provide means for supporting the at least one throwing device within the upward facing curve.

2. The game assembly of claim 1 wherein the at least one throwing device is a plurality of throwing devices.

3. The game assembly of claim 1 wherein the at least one throwing device is fabricated from rope.

4. The game assembly of claim 1 wherein the first scoring riser and the second scoring riser have different lengths.

5. The game assembly of claim 1 wherein the first scoring riser of the at least one target rack is 14-18 inches in height and the second scoring riser is 12-16 inches in height.

6. The game assembly of claim 1 wherein the at least one target rack is removably attached to the double stake structure.

7. The game assembly of claim 1 wherein the first scoring riser the at least one target rack is 14-18 in height and the second scoring riser is 12-16 inches in height;

wherein the at least one target rack has a bottom double stake structure integral with the rack;

wherein each stake of the bottom double stake structure is at least 8 inches in length; and wherein the at least one target rack is constructed from bamboo.

8. The game assembly of claim 1 wherein the first scoring riser of the at least one target rack is 14-18 in height and the second scoring riser is 12-16 inches in height; and wherein the at least one target rack is removably attached to the double stake structure.

9. The game assembly of claim 1 wherein the at least one throwing device further comprises a weighted portion.

10. The game assembly of claim 3 wherein the at least one throwing device further comprises a weighted portion.

11. A game assembly consisting of:

at least one target rack consisting of a vertically configured first and second scoring riser; and at least one throwing device configured in a ring shape with an inside diameter greater than the distance between the first scoring riser and second scoring riser;

wherein the at least one target rack has a bottom double stake structure consisting of two stakes, wherein the two stakes of the double stake structure form concave opposite walls partially surrounding a void between the stakes, wherein each stake of the double stake structure is at least 8 inches in length, wherein each stake of the double stake structure has a top end proximal to the target rack and a bottom end distal from the target rack, wherein each stake of the double stake structure is connected to each other only at the top end of each stake, wherein the target rack comprises an upward facing curve between the first scoring riser and the second scoring riser, and the upward facing curve and the first and second scoring riser together provide means for supporting the at least one throwing device within the upward facing curve.

* * * * *